US006562159B2

(12) United States Patent
Ampleman et al.

(10) Patent No.: US 6,562,159 B2
(45) Date of Patent: May 13, 2003

(54) INSENSITIVE MELT CAST EXPLOSIVE COMPOSITIONS CONTAINING ENERGETIC THERMOPLASTIC ELASTOMERS

(75) Inventors: Guy Ampleman, St-Augustin de Desmaures (CA); Patrick Brousseau, Québec (CA); Sonia Thiboutot, Québec (CA); Charles Dubois, Charny (CA); Emmanuela Diaz, Québec (CA)

(73) Assignee: Her Majesty the Queen in right of Canada, as represented by the Minister of National Defence, Ottawa (CA)

( * ) Notice: Subject to any disclaimer, the term of this patent is extended or adjusted under 35 U.S.C. 154(b) by 24 days.

(21) Appl. No.: 09/888,536

(22) Filed: Jun. 26, 2001

(65) Prior Publication Data

US 2002/0003016 A1 Jan. 10, 2002

Related U.S. Application Data

(60) Provisional application No. 60/214,489, filed on Jun. 27, 2000.

(51) Int. Cl.[7] ..... C06B 45/10; C06B 45/06; D03D 23/00

(52) U.S. Cl. ..... 149/19.4; 149/19.6; 149/18; 149/92; 149/109.6; 149/105

(58) Field of Search ..... 149/18, 19.4, 19.6, 149/92, 105, 109.6

(56) References Cited

U.S. PATENT DOCUMENTS

| | | | | | |
|---|---|---|---|---|---|
| 4,284,442 | A | * | 8/1981 | Voigt, Jr. | 149/19.4 |
| 4,325,759 | A | * | 4/1982 | Voigt, Jr. et al. | 149/19.92 |
| 4,445,948 | A | * | 5/1984 | Stanton et al. | 149/19.91 |
| 4,483,978 | A | * | 11/1984 | Manser | 528/408 |
| 4,707,540 | A | * | 11/1987 | Manser et al. | 528/417 |
| 4,806,613 | A | * | 2/1989 | Wardle | 528/59 |
| 4,952,644 | A | * | 8/1990 | Wardle et al. | 525/410 |
| 4,978,482 | A | * | 12/1990 | Johnson et al. | 264/3.1 |
| 4,985,093 | A | * | 1/1991 | McCulloch | 149/19.4 |
| 5,316,600 | A | * | 5/1994 | Chan et al. | 149/19.4 |
| 5,411,615 | A | * | 5/1995 | Sumrail et al. | 149/19.4 |
| 5,529,649 | A | * | 6/1996 | Lund et al. | 149/19.3 |
| 5,716,557 | A | * | 2/1998 | Strauss et al. | 264/3.3 |
| 5,717,158 | A | * | 2/1998 | Capellos et al. | 149/19.4 |
| 5,949,016 | A | * | 9/1999 | Baroody et al. | 149/18 |

* cited by examiner

*Primary Examiner*—Michael J. Carone
*Assistant Examiner*—Aileen B. Felton
(74) *Attorney, Agent, or Firm*—Nixon & Vanderhye P.C.

(57) ABSTRACT

An insensitive melt cast explosive composition obtained by dissolving an energetic copolyurethane thermoplastic elastomer ("ETPE") in melted trinitrotoluene ("TNT") is disclosed. The resulting ETPE-TNT solution is easy to mix with other ingredients such as nitramines, plasticizers, aluminum and can be processed with the existing melt cast facilities. The energetic solution can be poured into shells and upon cooling to produce a recyclable plastic bonded explosive. Instead of melted TNT, the same process works equally well with melted Octol or melted Composition B to dissolve the ETPE.

18 Claims, No Drawings

INSENSITIVE MELT CAST EXPLOSIVE COMPOSITIONS CONTAINING ENERGETIC THERMOPLASTIC ELASTOMERS

This application claims the benefit of Provisional Application No. 60/214,489, filed Jun. 27, 2000, the entire content of which is hereby incorporated by reference in this application.

FIELD OF THE INVENTION

The present invention relates to melt cast compositions containing new energetic copolyurethane thermoplastic elastomers. It concerns mainly the use of melted TNT as a solvent to dissolve these energetic thermoplastic elastomers to produce insensitive, recyclable, high-energy melt cast plastic bonded explosives.

BACKGROUND OF THE INVENTION

Conventional melt cast explosives consist of TNT or a dispersion of high-energy crystals in TNT. The most simple and widely used formulation is the mixing of melted trinitrotoluene ("TNT") with anti-cracking agent and waxes. Other compositions such as: Composition B, a mixture of TNT and hexahydro-1,3,5-trinitro-1,3,5-triazine ("RDX") (40:60); Octol, a mixture of TNT and octahydro-1,3,5,7-tetranitro-1,3,5,7-tetrazocine ("HMX")(30:70) and some other TNT compositions are mixed in melt-cast systems. These compositions are usually melted and cast into artillery shells, rockets, bombs etc. where they are allowed to cool and solidify. These explosive formulations exhibit poor mechanical properties and show undesirable defects such as cracks, exudation, voids, brittleness, which can affect the ballistic performance and the impact sensitivity. One way to improve the mechanical properties of the formulations is to introduce a rubbery binder which serves as binding agents for energetic products. These formulations will be able to absorb impact, resist heat, etc. Such munitions are considered to be insensitive or less sensitive than regular munitions.

High-energy solid compositions such as propellants and composite explosives are usually prepared by combining a variety of materials including oxidizers, binders, plasticizers and a curing agent. Many energetic binders are available for use in the preparation of these high-energy compositions. Usually, these binders are obtained by mixing the energetic or non-energetic prepolymers with the other ingredients followed by a curing reaction involving the use of polyisocyanates. The rubbery binders give the insensitive character to high-energy compositions (U.S. Pat. Nos. 5,061,330, 4,985,093, 4,012,245 and 4,988,397). For composite explosives, the use of these binders leads to plastic bonded explosives ("PBXs") which are chemically crosslinked and therefore not recyclable. A disadvantage of this technology resides in the fact that the mixing period is limited by the pot-life due to increased viscosity, and that long curing times at 60–80° C. are needed to crosslink the material leading to an expensive and undesirable process.

In general, formulators dislike doing a chemical reaction in their mixes since this leads to more complex batch processes. Moreover, the existing melt cast facilities are not suitable for these cast-cured PBXs.

A better way to prepare PBXs in melt cast facilities is to use thermoplastic elastomers leading to recyclable PBXs. High concentrations of these inert polymers make these compositions less hazardous, but also less energetic. The use of thermoplastic elastomers that are energetic will result in a loss of less energy. Some researchers identified inert thermoplastic elastomers and introduced them in melt cast formulations (U.S. Pat. Nos. 5,949,016, 4,284,442, 4,445,948, 4,978,482 and 4,325,759). Melting and mixing the thermoplastic elastomers with the other ingredients of the formulation to cast the final products was the ultimate goal of this invention. The limitation of this technology is that there are only a few thermoplastic elastomers that melt in the range of 80–100° C. and those melting at higher temperatures are not suitable for this process. Energetic thermoplastic elastomers of the type ABA and $AB_n$ melting at 83° C. were synthesized by Manser and Wardle but were very viscous and difficult to process in melt cast facilities (U.S. Pat. Nos. 4,483,978, 4,707,540, 4,806,613 and 4,952,644). In the present invention, energetic copolyurethane thermoplastic elastomers based on glycidyl azide polymer ("GAP") have been found to be completely dissolved by TNT and were introduced in melt-cast formulations to isolate new insensitive recyclable plastic bonded explosive compositions.

SUMMARY OF THE INVENTION

An object of the present invention is to provide a process using melted TNT as a solvent to dissolve energetic copolyurethane thermoplastic elastomers having melting points higher than 100° C. This was achieved in melt-cast systems and new insensitive melt-cast recyclable plastic bonded explosive compositions were isolated. This process using a melted explosive as a solvent for thermoplastic elastomers having melting points higher than 100° C. is not restricted to TNT and could be extended to other explosives that could eventually replace TNT in melt-cast formulations such as 1,3,3-trinitroazetidine ("TNAZ"). Plasticizers, energetic or not can also be used to dissolve the copolyurethane and introduce it in the formulation.

In accordance with one aspect of the present invention, there is provided a process to use melted TNT to dissolve energetic copolyurethane thermoplastic elastomer comprising linear polyurethanes physically cross-linked to one another by hydrogen bonds of the formula:

$$HO—P—(D—P)_n—D—P—OH$$

wherein D is a group resulting from the reaction of a diisocyanate with hydroxyl groups of two separate prepolymers; P is a dihydroxyl terminated telechelic energetic prepolymer having a functionality of two or less, reacted with the isocyanate groups of two separate diisocyanates and n is 1 to 100. A complete description of the structure and the syntheses of these copolyurethane thermoplastic elastomers can be found in U.S. patent application Ser. No. 09/058,865 (filed April, 1998), which is herein incorporated by reference.

Preferably, the dihydroxyl terminated telechelic energetic polymer has a molecular weight ranging from about 500 to about 10,000 and is selected from the group consisting of glycidyl azide polymer ("GAP"), poly 3-nitratomethyl-3-methyloxetane ("NIMMO") and poly glycidyl nitrate ("GLYN"), poly 3-azidomethyl-3-methyloxetane ("AMMO") and poly bis 3,3-azidomethyloxetane ("BAMO"). These energetic copolyurethane thermoplastic elastomers can include a chain extender. Suitable chain extenders are low molecular weight diols such as ethylene glycol or a diol of the formula:

$$OH—CH_2—(CH_2)_n—CH_2—OH$$

wherein n is 1 to 8. The chain extenders can have primary hydroxyl or secondary hydroxyl groups. The preferred chain extenders having secondary hydroxyl groups are 2,4-pentanediol or 2,3-butanediol. The chain extenders can also be low molecular weight diamines. Preferably, the diisocyanate is aromatic such as 4,4' methylenebis-phenyl isocyanate ("MDI") and toluene diisocyanate ("TDI") or aliphatic such as hexamethylene diisocyanate ("HMDI") and isophorone diisocyanate ("IPDI"). The resulting copolymer can be dissolved by melted TNT and be mixed with other components of a melt-cast formulation. Cooling of the mixture resulted in the re-formation of the physical crosslinking of the energetic thermoplastic elastomers to yield new recyclable plastic bonded explosives. Aluminum, magnesium and other state of the art additives can be added to the formulation to increase the performance and the mechanical properties.

The advantage of the present invention is to provide a simple way of introducing copolyurethane thermoplastic elastomers having melting points higher than 100° C. in melt-cast formulations using the existing facilities. Since melted TNT is used to dissolve the copolyurethane thermoplastic elastomers, the temperature of operation is the same as for the conventional melt cast formulations. Moreover, compared to cast-cure processes, there is no pot-life and no extended curing time to prepare the PBXs. Therefore, this process is an improved way of introducing energetic thermoplastic elastomers having melting points higher than 100° C. in melt-cast formulations, leading to new recyclable insensitive melt cast PBXs.

According to one aspect of the present invention, it provides the use of energetic copolyurethane thermoplastic elastomer ("ETPE") having melting point higher than 100° C. of the chemical structure:

(I)

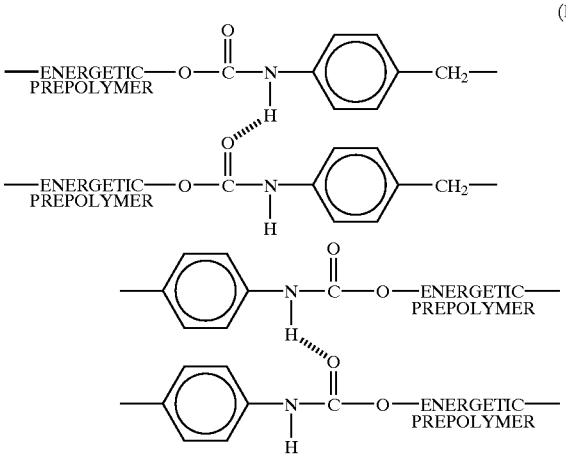

for manufacturing insensitive melt cast plastic bonded explosives.

According to another aspect of the present invention, it provides a method for manufacturing an insensitive plastic bonded explosive ("PBX") comprising dissolving the ETPE of the chemical structure (I) in an explosive solvent in a melt-cast system and cooling at room temperature.

DETAILED DESCRIPTION OF THE INVENTION

Energetic Copolyurethane Thermoplastic Elastomer ("ETPE")

Thermoplastic elastomers typically consist of copolymer chains having monomers A and B distributed throughout the chains as A—B—A or A—B, where A is the hard segment capable of crystallization or association and gives the thermoplastic behavior to the copolymer, and B is the soft segment which gives the elastomeric behavior to the copolymer. Conventionally, the A segment is formed by a crystalline homopolymer and the B segment is formed by an amorphous homopolymer.

In practice, at room temperature, a thermoplastic elastomer behaves like a rubber because it is cross-linked in the same fashion as a conventional elastomer, but with reversible physical cross-links. Since the physical cross-links are reversible, the thermoplastic elastomer can be melted or dissolved in a solvent, so that the polymer can be mixed with other components of, for example, a melt cast formulation. A gun or rocket propellant or a composite explosive could be isolated upon cooling or evaporating the solvent. Cooling or evaporating the solvent lets the broken physical cross-links reform and the elastomeric properties are recovered. Therefore, obsolete material can be melted or dissolved before the separation of the components, leading to a recyclable material.

In the present invention, a recyclable linear energetic copolyurethane thermoplastic elastomer having the following chemical structure:

(I)

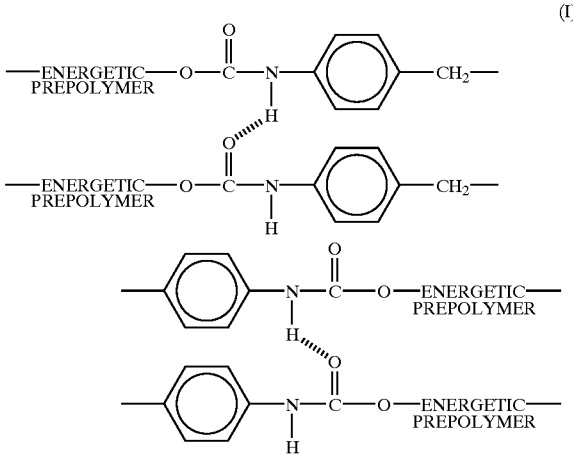

is dissolved by melted TNT. The synthesis of these energetic copolyurethane thermoplastic elastomers was previously described in U.S. patent application Ser. No. 09/058,865.

Generally, the energetic copolyurethane thermoplastic elastomers used in the present invention are obtained by polymerizing a dihydroxyl terminated telechelic energetic polymer having a functionality of two or less with a diisocyanate. Referring to structure (I), the energetic polymer is the elastomeric B segment and the thermoplastic A segment is provided by the group containing the urethane moieties. Suitable hydroxyl terminated energetic polymers are poly-GAP, poly-NIMMO, poly-GLYN, poly-AMMO and poly-BAMO, of molecular weights of about 500 to 10,000. Preferably, the diisocyanate is aromatic such as 4,4' methylenebis-phenyl isocyanate and toluene diisocyanate, or aliphatic such as hexamethylene diisocyanate and isophorone diisocyanate. Dibutyltin dilaurate is used as the curing reaction catalyst. Chain extenders such as ethylene glycol, 1,3-propanediol, 1,4 butanediol, 2,3-butanediol, 2,4-pentanediol or other low molecular weight diols or diamines may be added to obtain copolyurethanes having different hard segment contents. Likewise, the mechanical properties of the copolyurethane thermoplastic elastomer, which are determined by the numbers of hard and soft segments, can also be adjusted according to required needs.

As shown in structure (I), the urethane groups within the copolymer form hydrogen bonds with the oxygen of another urethane group or with the oxygen of an ether group, resulting in physical cross-links between the chains. The hydrogen bonds between the urethane groups give the hard segments of the thermoplastic elastomer and therefore the thermoplastic behavior. These hydrogen bonds are reversible, and hence, can be broken by dissolving the copolymer in an organic solvent such as melted TNT. Generally, it is possible to break the hydrogen bonds of most thermoplastic elastomers by melting them. However, in the case of GAP-based copolyurethane thermoplastic elastomers, the copolyurethanes should not be melted as both the decomposition of GAP and the melting point of polyurethanes occur at about 200° C. According to the literature, when there are enough hard segments to induce crystallinity, the melting points of linear polyurethanes are in the region of 200° C. when the thermoplastic content is about 20 to 50% by weight. Before finding that melted TNT can be used as an organic solvent, it was not possible to process these copolyurethanes in melt cast systems. It was postulated that TNT being an electron poor aromatic ring, has a great affinity for the electron rich aromatic rings of the MDI unit allowing the formation of π-complexes. This could explain why the copolymers wet the crystals so nicely and change dramatically the TNT mechanical properties. The structure and mechanical properties of the copolyurethane thermoplastic elastomers can be varied using different molecular weight of the prepolymers or using chain extenders which result in different hard segment contents. By varying the structure and the concentration (0.5 to 50% weight) of the copolyurethane thermoplastic elastomer in the formulation, a wide variety of energetic insensitive recyclable melt cast PBXs having different mechanical properties can be obtained. Recyclability of these new innovative PBXs was demonstrated showing that all components of the PBX can be quantitatively recuperated.

One limitation of using polymers such as ETPEs in melt cast processes is the fact that they increase the viscosity of the mixes compared to explosives mixes such as Composition B or Octol. High viscosity results in defects such as bubbles in the melt cast formulations and must be avoided. An elegant way to decrease the viscosity of the mix during the processing and casting is to lower the molecular weight of the copolymer or to polymerize the ETPE in-situ. Such in-situ polymerization of components with low molecular weight molecules ensures the lowest viscosity of the melt cast produced from the mixing and casting process.

Accordingly, it is another aspect of this invention to prepare an insensitive melt cast PBX using in-situ polymerization of the ETPE during the mixing and casting of the formulation. To achieve this, TNT or Composition B or Octol is melted and, instead of adding the ETPE as described earlier, the energetic prepolymers, the catalyst and the diisocyanate are added to the formulation followed by a stirring period of one hour. During this time, the copolymerization is taking place and the casting in shells followed by the cooling period that usually stands for hours will ensure that the polymerization is completed. The final result is an insensitive recyclable melt cast PBX with lower viscosity that is easier to process. Further researches will be conducted in this regard.

Materials

GAP $M_n$=2000 was obtained from 3M company, Minnesota, U.S.A. Dibutyltin dilaurate and 4,4' methylenebis-phenyl isocyanate were obtained from Aldrich Chemical Co., Milwaukee, Wis., U.S.A. Trinitrotoluene was type II TNT (melting point 80.6° C.). Octol type 1 (75/25 HMX/TNT) and type II (70/30 HMX/TNT) were obtained from Holston. The Composition B was obtained from Expro Chemical Products. All the copolyurethanes introduced in the melt cast compositions according to the present invention are rubber-like materials obtained following the procedure described in U.S. patent application Ser. No. 09/058,865. In the following examples, three different copolyurethane thermoplastic elastomers are used. They consist of polyurethane based on glycidyl azide prepolymers of molecular weight 1000 g/mole ("TPE 1000"), 2000 g/mole ("TPE 2000") and the combination of a prepolymer of 2000 g/mole and a chain extender, resulting in a TPE having 16% w/w of hard segments ("TPE 16%"). The resulting polymers were dissolved in melted TNT in a polymer concentration varying from 0.1 to 50% by weight. The resulting solvated materials can be cast and cooled to yield various desirable recyclable PBXs.

Preparation and Properties of PBXs

Different PBXs were prepared using melted TNT as the solvent with the copolyurethane at varying concentrations and hard segment content to yield PBXs with improved mechanical properties. As an example, TNT itself is a very hard and breakable solid, while the corresponding PBXs with a copolyurethane concentration at 15% by weight can be easily cut with a spatula. Furthermore, by swirling the product between fingers, a ball can be obtained that showed an excellent adhesion to any surface. In addition, other PBXs were also prepared using melted TNT followed by addition of RDX and HMX. Excellent mechanical properties were observed and the resulting performance were comparable to the performance of Composition B. In these formulations, the polymer concentration was set between 10–20%, the TNT concentration was at 20% and the nitramine concentration was at 60%. In general, polymer concentrations and explosive concentrations were set at 5–20% and 80–95% respectively. The sensitivity to impact and friction was decreased in all cases for all PBXs going from 10 N-m and 80 N for pure TNT to 25 N-m and over 360 N for PBXs. The same decrease of sensitivity was observed for Octol (Impact sensitivity 7.5 N-m and friction sensitivity 120 N) and Octol-based PBXs (Impact sensitivity 20 N-m and friction sensitivity over 360 N). All the vacuum stability tests showed stable compounds with an excellent compatibility between the ingredients. The viscosities of the PBXs varied from 200 poise to 800 poise, compared to melt cast Octol (40–150 poise) and cast cured PBX (1000–2000 poise). The thermal analyses demonstrated that introduction of copolyurethane thermoplastic elastomers lowered the melting point of TNT by 0–8° C. The glass transition temperatures of the PBXs were in the range of −30° C. at a polymer concentration of 20%, the PBXs being not plasticized. The use of plasticizers will lower the glass transition temperature and can also be used to dissolve the copolymers for introduction in the formulation.

From an industrial perspective, instead of using TNT and add RDX and HMX to the formulation, it would be more interesting to use directly available commercial Octol or Composition B explosives. Melting Octol or Composition B means melting TNT and introduction of the copolyurethane at this stage can be easily done. The mixing and casting of these formulations using Octol and Composition B were done and are described in the examples. The concentrations of polymer/Octol or polymer/Composition B were 5–20/80–95% respectively.

This invention is not restricted to the use of TNT as the solvent, other explosives that melt around 80–100° C. such as TNAZ could be used. The introduction of plasticizers could also be done to improve the thermal properties at low temperatures and or to dissolve the polymer for their introduction in the formulation. State of the art plasticizers such as DEGDN, TMETN, BDNPA/F or other plasticizers suitable for incorporation with GAP polymers can be added to the formulations. Other additives such as fuel aluminum, magnesium and those generally known in the art can also be included in these new PBXs.

Test Methods

Densities were measured based on standard ASTM D-792-91 method.

The stability of pure compounds and the compatibility with other products were verified by the Vacuum Stability Test based on STANAG 4479 (*Explosifs: Essai de stabilité* sous vide, NATO STANAG 4479, First Edition, 1995). One modification has been made on that procedure: the duration of the test was extended to 48 hours at 100° C. A gassing of more than 2 ml/g of sample indicates an incompatibility.

Julius Peter impact and friction apparatuses were used to test the sensitivity of mixtures (BICT, *Sensitivity to impact: BAM Impact test, test description and procedure,* Jun. 25, 1982). The minimum amount of energy necessary to have a sample reacting, either explosion or decomposition, was measured.

The viscosity was evaluated using a Brookfield apparatus model RVF. For each mixture, the measure was taken at four different rates (2, 4, 10 and 20 Rotations Per Minute-RPM).

The detonation velocity of the experimental compositions was measured on cylinders of explosives using ionisation probes. The cylinders were 2.54 cm in diameter and 20 cm long, and they were fired vertically. Initiation was made at the top using a pellet of RDX/wax (98.5/1.5) 3.18 cm in diameter by 2.54 cm long. A length of three diameters was left at the top to stabilise the detonation wave. Three probes were placed, separated by about 5.1 cm from each other, starting at 7.6 cm from the top. A small metal witness plate (7.6 cm×7.6 cm×0.65 cm) was placed underneath the cylinder to confirm the detonation of the cylinder. A small length (2.54 cm) was left at the bottom of the cylinder to avoid reflections off the witness plate. The distance between the probes was measured exactly and a counter recorded the time between each activation of the probes. Two velocities were then recorded. The reported value of the velocity is the total distance between the first and the third probe. The two velocities are used to verify that the velocity is constant and to evaluate the error on the measurement. All the cylinders measured for that study had a constant velocity at a diameter of 2.54 cm.

Thermal analysis were recorded on a Dupont DSC model 2910 under Helium (50 cc/min) between −100° C. and 100° C. at a rate of 10° C./min.

Rifle Bullet tests were performed according to the method found in the *Encyclopedia of Explosives and Related Items* (Fedoroff, B. T., Sheffield, O. E., *Encyclopedia of Explosives and Related Items,* PATR 2700, Volume 2, Picatinny Arsenal, Dover, N.J., USA, 1960). The explosives were cast in standard 2-inch pipes that were three inches long and fitted at both ends with standard screwed caps for 2-inch pipes. Bullets of calibre 7.62 mm (Ball C21) were fired at the items.

The following examples illustrate the performance of the process according to the invention.

EXAMPLE 1

PBX Based on TPE 2000-TNT at 20% by Weight

In a small flask, 12 g of TNT were added to 3 g of bulk TPE 2000. The ratio of TPE to TNT was then 20/80. The flask was placed in a bath at 95° C. Once the TNT was melted, the mixture was stirred for two hours using a mechanical stirrer. The homogeneous liquid was then cast and cooled slowly to room temperature. The density of the resulting PBX was 1.49 g/cc, compared to the density of pure TNT of 1.60 g/cc. The impact sensitivity was 20 N-m and the friction sensitivity over 360 N, compared with 10 N-m and 80 N measured for pure TNT. The glass transition was found to be −33° C. and the melting point 79.0° C.

EXAMPLE 2

PBX Based on TPE 1000-TNT at 30% by Weight

In a small flask, 10.5 g of TNT were added, with 4.5 g of bulk TPE 1000. The ratio of TPE to TNT was then 30/70. The flask was placed in a bath at 95° C. Once the TNT was melted, the mixture was stirred for two hours using a mechanical stirrer. The homogeneous liquid was then cast and cooled slowly to room temperature. The density of the resulting PBX was 1.46 g/cc. The impact sensitivity was 25 N-m and the friction sensitivity over 360 N. The glass transition was −17° C. and the melting point 73.0° C. The solidified mix could be easily cut using a knife.

EXAMPLE 3

PBX Based TPE 2000-Octol at 20% by Weight

In a jacketed pot heated at 100° C., 400 g of Octol type II were melted. Bulk TPE 2000 (100 g) was added in four portions of 25 g under agitation with a mechanical stirrer. The ratio of TPE to Octol was then 20/80. The mixture was stirred at 100° C. for two hours. The homogeneous liquid was then cast and cooled slowly to room temperature. The density of the resulting PBX was 1.59 g/cc, compared to the density of pure Octol of 1.80 g/cc. The impact sensitivity was 20 N-m and the friction sensitivity over 360 N. The glass transition was −28° C. and the onset of melting was at 64° C. The detonation velocity was measured at 7390 m/s at a density of 1.59 g/cc.

EXAMPLE 4

PBX Based on TPE 2000-Comp. B at 20% by Weight

In a small flask, 12 g of Composition B were added to 3 g of bulk TPE 2000. The flask was placed in a bath at 95° C. Once the TNT was melted, the mixture was stirred for two hours using a mechanical stirrer. The homogeneous liquid was then cast and cooled slowly to room temperature. The density of the resulting PBX was 1.56 g/cc. The impact sensitivity was 20 N-m and the friction sensitivity 240 N. This compares well with the values of impact and friction sensitivities measured for pulverized Composition B at 5 N-m and 240 N, respectively. The solidified mix could be easily cut using a knife.

EXAMPLE 5

PBX Based on TPE 16%-Octol at 20% by Weight

In a jacketed pot heated at 100° C., 400 g of Octol type II were melted. Bulk TPE 16% (100 g) were added in four portions of 25 g under agitation with a mechanical stirrer. The mechanical properties of the TPE 16% are between those of TPE 1000 and TPE 2000. The mixture was stirred at 100° C. for two hours. The homogeneous liquid was then cast and cooled slowly to room temperature. The density of the resulting PBX was 1.61 g/cc, compared to the density of pure Octol of 1.80 g/cc. The impact sensitivity was 20 N-m and the friction sensitivity over 360 N. The detonation velocity was measured at 7372 m/s at a density of 1.61 g/cc. The solidified mix could be easily cut using a knife. It is harder than the same mix prepared with TPE2000 and softer than the one with TPE 1000. This family of polymers with a selected percentage of hard segments provides a flexibility to obtain products with the desired mechanical properties.

EXAMPLE 6

PBX Based on TPE 2000-Octol at 5% by Weight

In a jacketed pot heated at 100° C., 2755 g of Octol type II were melted. Bulk TPE 2000 (145 g) was added in four portions of 36.25 g under agitation with a mechanical stirrer. The ratio of TPE to Octol was then 5/95. The mixture was stirred at 100° C. for two hours. The homogeneous liquid was then cast and cooled slowly to room temperature. The density of the resulting PBX was 1.70 g/cc, compared to the density of pure Octol of 1.80 g/cc. In the Rifle Bullet test, 10% of the cylinders reacted violently to the test, 60% of the cylinders showed only a burning reaction and 30% of the cylinders did not react at all. In comparison, 100% of the cylinders filled with Composition B and 100% of the cylinders filled with Octol type II produced a violent reaction after the attack (deflagration/explosion).

EXAMPLE 7

Recycling of a PBX TPE 2000-Octol

Recycling was achieved successfully and separation of the ingredients was done using different solvents and extraction techniques. As an example, a PBX containing 20% of copolyurethane and 80% of Octol (10 g) was placed in chloroform (50 mL) to precipitate the nitramines which were filtered and quantitatively recovered. The filtrate containing a mixture of the copolyurethane and TNT was evaporated to dryness and placed in a soxhlet tumble for extraction with ethanol (100 mL) using a soxhlet extractor. After 5 days of continuous extraction, the ethanol solution containing TNT was evaporated and pure TNT was recovered. The residue contained in the soxhlet tumble was dissolved using ethyl acetate (100 mL) and spectroscopic analyses revealed no traces of TNT or nitramines in the copolyurethane. Complete separation was then quantitatively achieved allowing the recovery of pure components of the PBXs. If one considers that all the solvents involved in the recycling process can be recuperated, the recuperation of starting materials becomes inexpensive and highly feasible. Likewise, it is easy to employ a one-step operation to recover only the expensive nitramines.

Discussion

A new family of PBXs based on TNT, Octol or Composition B and various concentrations of GAP based thermoplastic elastomers was obtained. The energetic polymers were highly soluble in melted TNT and they led to low viscosity mixtures that were easily processed. The introduction of polymeric materials in these formulations led to PBXs with more desirable mechanical properties and lower TNT exudation. Moreover, a measurable increase of insensitiveness toward external stimuli was observed for all formulations. The introduction of energetic polymers produces PBXs with comparable performance as Composition B. These new formulations represent a useful alternative to conventional melt cast explosives and cast cured PBXs. As in the case with conventional melt cast explosives, the new formulations can be easily processed in existing industrial facilities. They show advantages similar to cast cured PBXs without having to deal with pot-life and long curing times. Moreover, they are completely recyclable, which represents a great advantage in a "cradle to grave" management of the munitions stockpile. These PBXs can be easily demilitarized after their useful lifetime and starting materials can be recuperated and recycled.

It is to be understood that the embodiments and variations shown and described herein are merely illustrative of the principles of this invention and that various modifications may be implemented by those skilled in the art without departing from the scope and spirit of the invention.

What is claimed:

1. A method for manufacturing an insensitive plastic bonded explosive ("PBX") comprising dissolving ETPE having melting point higher than 100° C. of the chemical structure:

(I)

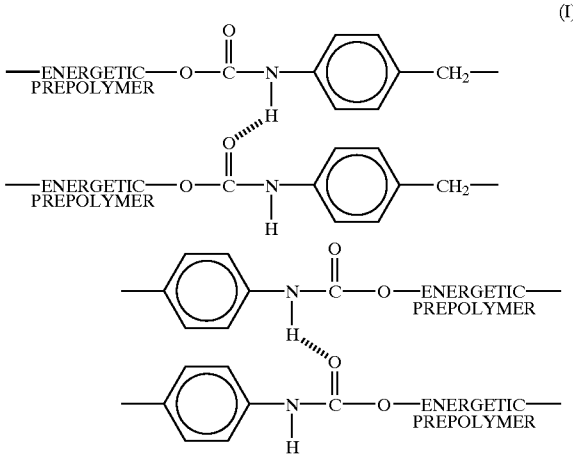

in an explosive solvent in a melt-cast system and cooling at room temperature.

2. A method for manufacturing an insensitive plastic bonded explosives ("PBX") comprising dissolving 5–20% by concentration of ETPE having melting point higher than 100° C. of the chemical structure:

(I)

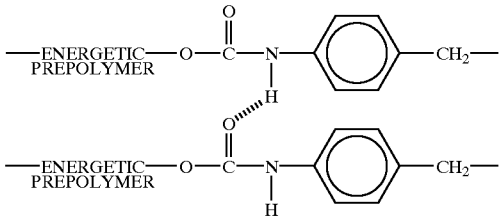

-continued

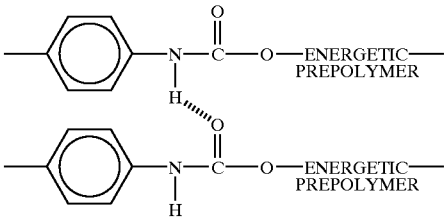

in 80–95% by concentration of an explosive solvent in a melt-cast system and cooling at room temperature.

3. A method for manufacturing an insensitive PBX as in claim 1, said method is carried out in-situ.

4. A method for manufacturing an insensitive PBX as in claim 1, said ETPE is glycidy azide polymer ("GAP") based.

5. A method for manufacturing an insensitive PBX as in claim 1, said explosive solvent is melted trinitrotoluene ("TNT").

6. A method for manufacturing an insensitive PBX as in claim 1, said explosive solvent is a mixture of TNT and hexahydro-1,3,5-trinitro-1,3,5-triazine (40:60) ("Composition B").

7. A method for manufacturing an insensitive PBX as in claim 1, said explosive solvent is a mixture of TNT and octahydro-1,3,5,7-tetranitro-1,3,5,7-tetrazocine (30:70) ("Octol").

8. A method for manufacturing an insensitive PBX as in claim 1, said explosive solvent is Composition B.

9. A method for manufacturing an insensitive PBX as in claim 1, said explosive solvent is Octol.

10. A method for manufacturing an insensitive PBX as in claim 4, said TNT is replaced by a suitable explosive having melting point at around 80–100° C.

11. A method for manufacturing an insensitive PBX as in claim 4, said TNT is replaced by 1,3,3-trinitroazetidine ("TNAZ").

12. A method for manufacturing an insensitive PBX as in claim 1, further comprising adding a plasticizer to the formulation prior to said melt-cast step.

13. A method for manufacturing an insensitive PBX as in claim 11, said plasticizer is either energetic or non-energetic.

14. A method for manufacturing an insensitive PBX as in claim 11, said plasticizer is selected from the group consisting of DEGDN, TMETN, BDNPA/F or other plasticizers suitable for incorporation with GAP based polymers.

15. A method for manufacturing an insensitive PBX as in claim 1, with the further addition of fuel aluminum or magnesium.

16. The insensitive PBX manufactured in accordance with claim 1, said PBX displaying impact sensitivity of about 25 N-m and friction sensitivity of about 360 N.

17. The insensitive PBX manufactured in accordance with claim 1, said PBX displaying with viscosities varying between 200 to 800 poise.

18. The insensitive PBX manufactured in accordance with claim 1, said PBX displaying glass transition temperatures of about −30° C. at ETPE concentration of 20%.

* * * * *